US005817981A

United States Patent [19]

Arroyo

[11] Patent Number: 5,817,981

[45] Date of Patent: Oct. 6, 1998

[54] COAXIAL CABLE

[75] Inventor: Candido John Arroyo, Lithonia, Ga.

[73] Assignee: Lucent Technologies Inc., Murry Hill, N.J.

[21] Appl. No.: 523,701

[22] Filed: Sep. 5, 1995

[51] Int. Cl.[6] ..... H01B 11/18

[52] U.S. Cl. ..... 174/110 N

[58] Field of Search ..... 174/110 N, 28, 174/102 R, 102 P, 102 C, 116

[56] References Cited

U.S. PATENT DOCUMENTS

| | | | |
|---|---|---|---|
| 3,287,489 | 11/1966 | Hvizd, Jr. | 174/102 R |
| 4,123,585 | 10/1978 | Sparzak et al. | 428/379 |
| 4,319,940 | 3/1982 | Arroyo et al. | 156/56 |
| 4,340,773 | 7/1982 | Perreault | 174/102 C |
| 4,412,094 | 10/1983 | Dougherty et al. | 174/110 F |
| 4,419,157 | 12/1983 | Ferrentino | 174/102 P |
| 4,510,348 | 4/1985 | Arroyo et al. | 174/121 A |
| 4,512,827 | 4/1985 | Gill | 174/102 P |
| 4,515,993 | 5/1985 | MacKenzie | 174/102 R |
| 4,552,989 | 11/1985 | Sass | 174/103 |
| 4,595,793 | 6/1986 | Arroyo et al. | 174/121 A |
| 4,600,805 | 7/1986 | Glynn et al. | 174/102 R |
| 4,665,281 | 5/1987 | Kamis | 174/102 R |
| 4,679,898 | 7/1987 | Grooten | 174/107 |
| 4,688,889 | 8/1987 | Pasini et al. | 350/96.23 |
| 4,695,127 | 9/1987 | Ohlaber et al. | 350/96.23 |
| 4,873,393 | 10/1989 | Friesen et al. | 174/34 |
| 4,941,729 | 7/1990 | Hardin et al. | 350/96.23 |
| 4,970,352 | 11/1990 | Satoh | 174/102 C |
| 5,074,640 | 12/1991 | Hardin et al. | 385/109 |
| 5,162,609 | 11/1992 | Adriaenssens et al. | 174/34 |
| 5,261,021 | 11/1993 | Pasta et al. | 174/23 R |
| 5,293,678 | 3/1994 | Chamberlain et al. | 29/401.1 |

*Primary Examiner*—Kristine L. Kincaid
*Assistant Examiner*—Marc D. Machtinger

[57] ABSTRACT

A coaxial cable has an inner conductor coated with a first dielectric material and which is surrounded and encased in a second dielectric material having a lower dielectric constant than the first material. The layer formed by the second dielectric material is surrounded by a layer of insulating material having a higher dielectric constant than that of the second material which preferably is in the form of a helically wound tape which is adhesively bonded or heat sealed over the second material. An outer conductor surrounds the layer of insulating material, and the entire assembly is encased in an outer jacket of insulating material.

12 Claims, 1 Drawing Sheet

COAXIAL CABLE

FIELD OF INVENTION

This invention relates to coaxial cables, and, more particularly, to a coaxial cable having a composite insulation structure.

BACKGROUND OF THE INVENTION

Communication systems in the present day environment are of vital importance, and, as technology continues to become more sophisticated, such systems are required to transmit signals substantially error free at higher and higher bit rates. More particularly, it has become necessary to transmit data signals over considerable distances at high bit rates, such as megabits and gigabits per second, and to have substantially error free transmission. Thus, desirably, the medium over which these signals are transmitted must be capable of handling not only low frequency and voice signals, for example, but higher frequency data and video signals. In addition, one aspect of the transmission that must be overcome is crosstalk between pairs of commercially available cables. One of the most efficient and widely used signal transmission means which has both broad band capability and immunity from crosstalk interference is the well known coaxial cable.

The coaxial cable comprises a center conductor surrounded by an outer conductor spaced therefrom, with the space between the two conductors comprising a dielectric, which may be air but is, most often, a dielectric material such as foamed polyethylene. The coaxial cable transmits energy in the TEM mode, and has a cut-off frequency of zero. In addition, it comprises a two-conductor transmission line having a wave impedance and propagation constant of an unbounded dielectric, and the phase velocity of the energy is equal to the velocity of light in an unbounded dielectric. The coaxial line has other advantages that make it particularly suited for efficiency operation in the hf and vhf regions. It is a perfectly shielded line and has a minimum of radiation loss. It may be made with a braided outer conductor for increased flexibility and it is generally impervious to weather. Inasmuch as the line has little radiation loss, nearby metallic objects and electromagnetic energy sources have minimum effect on the line as the outer conductor serves as a shield for the inner conductor. As in the case of a two-wire line, power loss in a properly terminated coaxial line is the sum of the effective resistance loss along the length of the cable and the dielectric loss between the two conductors. Of the two losses, the resistance loss is the greater since it is largely due to skin effect and the loss will increase directly as the square root of the frequency.

The most commonly used coaxial cable is a flexible type having an outer conductor consisting of copper wire braid, with the copper inner conductor supported within the outer by means of the dielectric, such as foamed polyethylene, which has excellent low-loss characteristics. The outer conductor is protected by a jacket of a suitable material, such as, for example, polyvinyl chloride (PVC) or polyethylene (PE). Normally, the jacket does not affect the electrical characteristics of the cable but has a marked effect on the physical characteristics thereof. Thus, a PVC jacket, for instance, can cause the cable to be too stiff for easy manipulation. To overcome the stiffness, the manufacturers often introduce a plasticizer into the jacket material which improves cable flexibility. However, eventually most plasticizers tend to migrate through the outer conductor and attack the inner insulation between outer and inner conductors, greatly increasing the rf loss of the dielectric, i.e., the insulating material and, concomitantly, shortening the useful life of the cable. Another expedient aimed at increasing cable flexibility is a reduction in the tightness or closeness of the braided outer conductor. However, too great a reduction in the braid will produce undesirable gaps therein when the cable is bent which can and does result in rf leakage, even at low frequencies.

The higher frequencies transmitted by coaxial cable are subject to greater loss than lower frequencies as a result of the skin effect, the loss increasing directly as the square root of the frequency. Thus, there is a practical upper frequency limit for the cable, beyond which the loss is too great. This loss can be overcome, at least in part, by an increase in the diameter of the inner conductor, which has the effect of raising the upper frequency limit and thus increasing the bandwidth capability of the cable. Unfortunately, the characteristic impedance and the power losses in a coaxial line are directly proportional to the ratio of the inner conductor diameter to the outer conductor diameter, i.e., the separation between them which is filled with dielectric. This implies that an increase in the inner conductor diameter requires a similar increase in that of the outer conductor to maintain the desired electrical performance, which in turn necessitates an increase in the thickness of the dielectric. The increased thickness of the dielectric, when it is, for example, polyethylene, results in an undesirable increase in cable stiffness, making it more difficult to handle and to route in desired directions and bends.

One important factor controlling the power capability of coaxial line is heat, most of which is generated in the center conductor. The ability of the inner dielectric material to withstand the heat and its effectiveness in transferring heat to the outer conducting shield and jacket are limiting factors. The use of TEFLON® as an inner dielectric permits higher center conductor operating temperatures. However, the same problems as mentioned in the foregoing arise when dimensional changes aimed at increasing the bandwidth are implemented.

SUMMARY OF THE INVENTION

The present invention is a coaxial cable which has a dielectric or insulation member between the inner and outer conductors which is a composite structure of foamed polyethylene and a second member of insulating material having a higher dielectric constant than the foamed polyethylene. In addition, in a preferred embodiment of the invention, the inner conductor is coated with a material having a higher dielectric constant than the foamed polyethylene. The configuration of the coaxial cable of the invention is thus a coating layer of relatively high dielectric constant on the inner conductor, a surrounding layer of an insulating material such as foamed polyethylene, and a polyimide material tape helically wrapped and adhesively bonded or heat sealed over the insulating material between the insulating material and the outer conductor. The outer conductor in turn is encased in a polyethylene or polyvinyl-chloride jacket. Such a layered structure of the insulation results in a total insulation thickness less than that which is necessary when the insulation is one homogeneous material. Thus, an increased diameter inner conductor does not require a corresponding increase in the diameter of outer conductor inasmuch as the higher dielectric material produces electrical characteristics substantially the same as would be present with a much thicker single dielectric or insulator. The outer conductor, in an embodiment of the invention, has a thin layer of hydrophilic powder material between it and the outer jacket.

The various principles and features of the present invention will be more readily apparent from the following detailed description, read in conjunction with the accompanying drawing.

DETAILED DESCRIPTION

Figure 1:
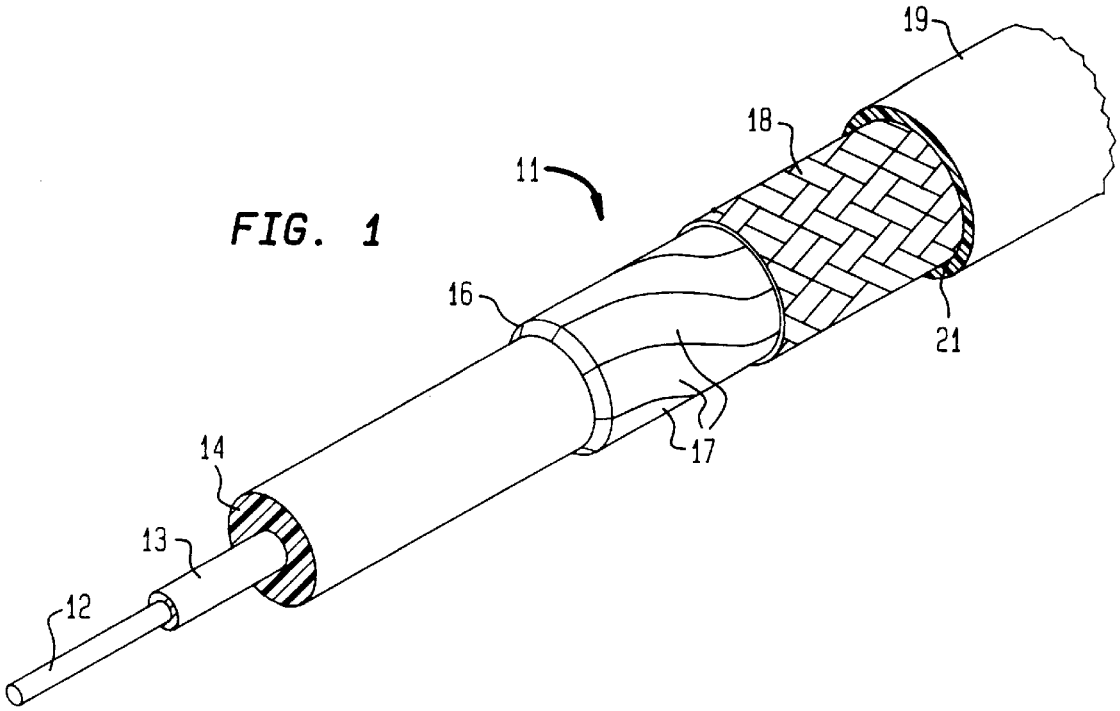
FIG. 1 is a perspective, partially cut-a-way view of the coaxial cable of the invention.

Coaxial cable 11 of FIG. 1, which embodies the principles and features of the present invention, comprises an inner conductor 12 which is coated with a layer 13 of material having a relatively high dielectric constant, which, in turn, is surrounded by a layer of, preferably, foamed polyethylene 14. By "relatively high" is meant a dielectric constant that is greater than that of foamed polyethylene, or whatever material is used to form layer 14. For example, the foamed polyethylene forming layer 14 has a dielectric constant of approximately 1.2. Layer 13, on the other hand, which may be formed by coating conductor 12 with a liquid polyimide, such as, for example, KAPTON®, preferably has a dielectric constant of 3.1–3.7, and is preferably less than 1.0 mils thick. Layer 13 has the effect of slightly increasing the overall dielectric constant of the combination of layers 13 and 14, without materially increasing the stiffness or overall diameter of the cable components discussed thus far.

In accordance with the principles of the invention, layer 14 is covered with a layer 16 of an insulating material having a higher dielectric constant than that of the material of layer 14. Layer 16 is preferably applied in the form of spirally or helically wound tapes 17, as shown, and is preferably a polyimide material such as KAPTON® tape or film. Most polyimides have outstanding mechanical properties and excellent thermal and oxidative stability. As such, they are considerably more expensive per unit weight than polyethylene, as well as other specialized plastic materials such as tetrafluoroethylene fluorocarbon polymers such as Teflon® which is often used as substitute for polyethylene. However, because of the higher dielectric constant of KAPTON® as compared to both polyethylene and TEFLON®, the thickness of the tape 17 forming layer 16 may be, and preferably is, in the range of 0.5 to 1.0 mils. The tape 17 is affixed to the outer surface of layer 14 by adhesive bonding or heat sealing, thereby encasing layer 14. The use of tape 17 makes possible the custom tailoring of the coaxial cable to any particular desired application. Thus, two or more layers of tape may be used instead of the one layer 16 shown in FIG. 1, depending upon how much of an increase in the dielectric constant of the composite insulation is desired. The layer 16 is covered with the outer conductor 18 of the coaxial cable which preferably is in the form of mesh braid or solid copper, aluminum, or other conducting material, and the entire assembly is enclosed within a jacket 19 of suitable insulating material such as, for example, polyethylene or polyvinylcholoride (PVC). If desired, a layer 21 of a superabsorbent powdered material may overlie the metallic member 18 and be sandwiched between member 18 and jacket 19. Layer 21 is best formed by electrostatic deposition of, for example, a hydrophilic powder. Such a powder may be a polymer or a polyelectrolyte such as polyacrylic acid, and possesses the property of swelling when impinged upon by water, for example, to block the flow of such liquid along the length of the cable. Obviously such a superabsorbent material is most useful in those cable environments where moisture or water is present, but it may be incorporated into the cable regardless of planned use.

Figure 2:
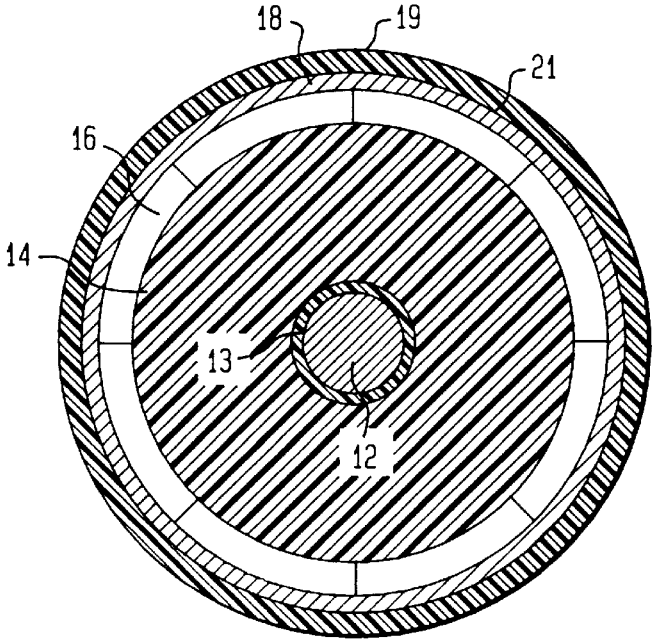
FIG. 2 is a cross-sectional view of the cable of FIG. 1.

The principles of the invention have been illustrated in an embodiment thereof where a polyimide material, e.g., KAPTON® is used to create the composite dielectric. It is also possible that a tetrafluoroethylene fluorocarbon polymer, such as, for example, TEFLON®, can be used. However, in the configuration of the cable of the invention shown in FIGS. 1 and 2, the layer 16 would have to be approximately twice as thick as for a polyimide material to accomplish the same end.

The principles of the invention have been illustrated as applied in a preferred embodiment thereof. Various modifications or alterations might occur to workers in the art without departing from the spirit and scope of these principles.

I claim:

1. A coaxial communication cable for the transmission of high frequency signals, comprising:

a first conductor member forming an inner conductor of said coaxial cable;

a first insulating member of a material having a first dielectric constant surrounding and enclosing said first conductor member;

a second insulating member surrounding and enclosing said first insulating member, said second insulating member of a material having a second dielectric constant greater than the dielectric constant of said first insulating member;

a second conductor member surrounding and enclosing said second insulating member; and a jacket of insulating material surrounding and enclosing said second conductor member.

2. The communication cable of claim 1 and further comprising a coating of materials on said first conductor member having a dielectric constant greater than that of said first insulating member.

3. The communication cable of claim 1 and further comprising a layer of superabsorbent material on said second conductor member between said second conductor member and said jacket.

4. The communication cable of claim 3 and further comprising a coating of material on said first conductor member having a dielectric constant greater than that of said first insulating member.

5. The communication cable of claim 1 wherein the material of said first insulating member is foamed polyethylene.

6. The communication cable of claim 1 wherein the material of said second insulating member is a polyimide material.

7. The communication material of claim 6 wherein said second insulating member is in the form of a tape overlying said first insulating member and bonded thereto.

8. The communication cable as claimed in claim 6 wherein the polyimide material is a film.

9. A coaxial communication cable for the transmission of high frequency signals comprising:

a first conductor member forming an inner conductor of said cable, said first conductor member having a coating of polyimide material thereon;

a first insulating member of polyethylene surrounding said first conductor member in contact with said coating;

a second insulating member of a polyimide material surrounding said first insulating member and bonded thereto;

a second conductor member surrounding and enclosing said second insulating member; and a jacket of insulating material surrounding and enclosing said second conductor member.

10. A communication cable as claimed in claim 9 wherein said second insulating member comprises polyimide tape helically wound around said first insulating member.

11. A communication cable as claimed in claim 9 wherein the polyimide material of said coating and said second insulating member is a film.

12. A communication cable as claimed in claim 9 and further comprising a layer of superabsorbent material on said second conductor member between said second conductor member and said jacket.

* * * * *